United States Patent [19]

Martin

[11] 3,949,329

[45] Apr. 6, 1976

[54] RADIATING TRANSMISSION LINES

[75] Inventor: David James Reginald Martin, Leatherhead, England

[73] Assignee: Coal Industry (Patents) Ltd., London, England

[22] Filed: Jan. 22, 1974

[21] Appl. No.: 435,415

[30] Foreign Application Priority Data

Feb. 13, 1973 United Kingdom..... 06938/73

[52] U.S. Cl...... 333/84 L; 333/95 S; 343/771

[51] Int. Cl.[2] ..... H01Q 13/28

[58] Field of Search..... 333/84 L, 84 R, 95 S, 96 R; 343/770, 771, 785, 731; 174/108

[56] References Cited

UNITED STATES PATENTS

| | | | |
|---|---|---|---|
| 2,133,863 | 10/1938 | Knoderer | 174/108 |
| 2,867,778 | 1/1959 | Hafner | 333/95 S |
| 3,077,569 | 2/1963 | Tkrath | 333/95 S |
| 3,735,293 | 5/1973 | Breitenbach | 343/771 |
| 3,810,186 | 5/1974 | Makahara et al. | 333/84 R |

FOREIGN PATENTS OR APPLICATIONS

| | | | |
|---|---|---|---|
| 1,812 | 1859 | United Kingdom | 174/108 |
| 24,405 | 1897 | United Kingdom | 174/108 |

OTHER PUBLICATIONS

Barlow et al., "An investigation of the Characteristics of Cylindrical Surface Waves," Proc. IEE, Vol. 100, pt. III, 11–1953, pp. 321–328.

Barlow et al., "An experimental Investigation of the Properties of Corrugated Cylindrical Surface Waveguides," Proc. IEE, Vol. 101, pt. III 5–1954, pp. 182–188.

*Primary Examiner*—Alfred E. Smith
*Assistant Examiner*—Wm. H. Punter
*Attorney, Agent, or Firm*—James C. Wray

[57] ABSTRACT

A leaky feeder coaxial cable has the inductance of the outer conductor altered by winding an extra conductor on the outer conductor or by physically forming the outer conductor so that it is unsymmetrical.

6 Claims, 4 Drawing Figures

RADIATING TRANSMISSION LINES

This invention relates to radiating transmission lines and is concerned particularly, but not exclusively with such transmission lines when used in tunnels or mines.

One particular problem which arises in transmitting radio signals in tunnels or mines is that the enclosed area of the tunnel or mine limits the degree of propagation of radio waves. In order to overcome this a number of alternative suggestions have been made based on the use of a radiating transmission line which extends along the length of the tunnel or mine and which is fed with a radio frequency signal. This signal radiates from the line which thus acts as a form of aerial and the signal is picked up locally by radio receivers in the mine. The receivers may also incorporate transmitters which can transmit to the line and signals received there are picked up and propagated back along the line to a receiver. Transmission to and from the mobile receivers usually takes place at different frequencies for operational reasons and different mobile receivers/transmitters may operate at different frequencies.

A number of forms of radiating transmission lines have been suggested, among the simplest of which have been coaxial cables having loosely wound braid. An alternative has been a coaxial cable having a tubular outer conductor which has an open seam or a series of slots or holes through which radio signals can propagate. These cables have been known as "leaky cables", "leaky feeders" or "leaky lines".

When the braid type of conductor has been used the optical cover of the braid has been reduced by up to 50% by omitting certain of the normal braid wires. Depending on the amount of optical cover so used the strength of the signal radiated is increased.

However, reducing the braid cover in this way also introduces the disadvantage that the longitudinal attenuation of the signals in the line is increased, and the range of communication thereby decreased, owing to the increased electrical resistance of the braid resulting from the reduction in the number of wires forming it. This loss partially offsets the advantage otherwise gained by reducing the braid cover, and limits the useful degree of reductions in braid cover.

It is commonly accepted that the radiation which takes place from imperfect coaxial cables of this nature is a function of a quantity known as the "surface transfer impedance", or "coupling impedance", a property of the braid itself which can be measured by standard means and which in particular depends on the optical braid cover.

An analysis of the radiation process indicates that the surface transfer impedance is only one of several properties of the cable which influence the radiation. The other significant factors include the attenuation constant of a wave propagated along the outside surface of the outer braid and the velocity ratios of the normal wave within the coaxial cable and of a wave propagated along the outside. It can be shown that the radiation reaches a maximum when these two velocity ratios are equal.

A velocity ratio is a rate at which waves of voltage or current travel in a transmission line or other inductive-capacitive path, expressed as a fraction or a percentage of the rate in free space. Harold P. Manly, *Radio-Television Electronic Dictionary*, Frederick J. Drake & Co., Chicago, 1960.

In order to produce a cable having a high radiation therefore it is desirable to arrange that the velocity ratios of the internal wave and of a wave propagated along the outside are as close as possible. The velocity ratio of the outside wave is normally between 0.8 and 1.0. The velocity ratio of the inner wave is dependent on the dielectric material and construction, and for a solid polythene dielectric is 0.67. It is possible to increase this value to 0.8 or greater by changing the dielectric to one of a semi-airspaced construction such as cellular polythene or "thread and tube" construction. However, these constructions have the disadvantage that they allow water, once ingressed, to penetrate through the cable and so must preferably be avoided in wet environments such as occur in some mines.

It is an object of the present invention to provide a radiating transmission line which substantially overcomes these disadvantages.

According to the present invention, a coaxial cable of the kind comprising an inner core, a surrounding dielectric material and a perforate outer conductor includes inductance means associated with the outer conductor for increasing the inductance of the said outer conductor as seen by the surface-propagated wave.

The inductance means may be incorporated in the outer conductor itself where a braided conductor is used by constructing the braid asymetrically, for example with more turns of wire in one direction than in the other. Alternatively, a separate conductor may be helically wound around the outer conductor of the transmission line. This separate conductor may be insulated from the outer conductor or in electrical contact therewith. A wire or tape of heavy gauge may suitably be used.

The incorporation of the extra inductance means will have the effect of altering the velocity ratio of the wave on the outer surface of the outer conductor and of reducing it by suitably calculating and arranging inductance effect to the velocity ratio of the wave in the internal conductor.

BRIEF DESCRIPTION OF THE DRAWINGS

In order that the invention may be readily understood two examples of coaxial cable constructed in accordance therewith will now be described with reference to the accompanying drawings in which.

DETAILED DESCRIPTION OF THE DRAWINGS

Figure 1:
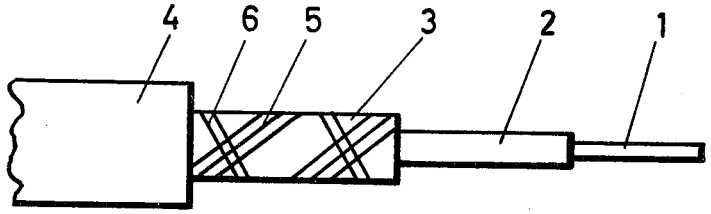
FIG. 1 shows the stripped back end of a first cable and FIG. 2 a stripped back end of a second cable.
Figure 3:
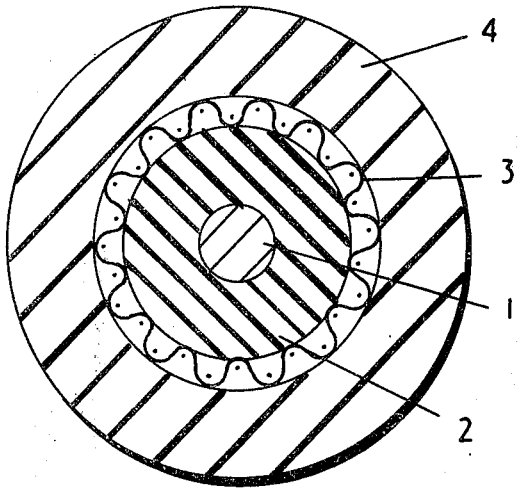
FIG. 3 is a cross section of the cable shown in FIG. 1.

Referring first to the cable of FIGS. 1 and 3 this comprises a solid core 1 surrounded by a solid polythene dielectric 2 and a coaxial braided wire outer conductor 3 covered by an insulating sheath 4. The outer conductor 3 has as inductance means more turns of wire in the braid in its left hand thread 5 than in its right hand thread 6 in comparison with a normal coaxial cable which would have equal numbers in each thread.

Figure 2:
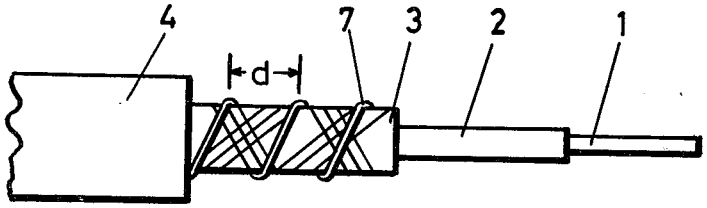
Figure 4:
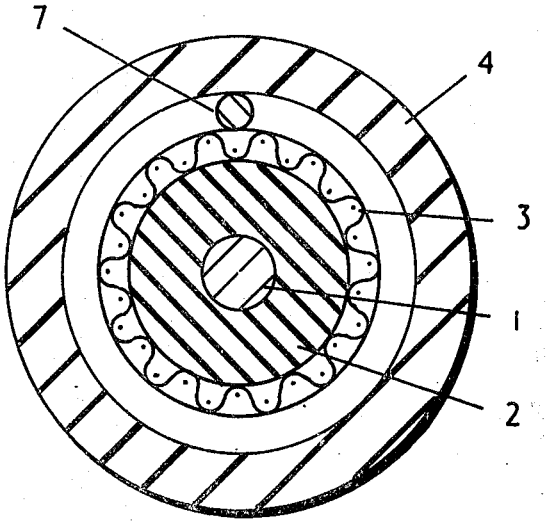
FIG. 4 is a cross section of the cable shown in FIG. 2. Both cables are suitable for use as radiating transmission lines in a mine or tunnel.

Referring now to the second example of FIGS. 2 and 4 where similar reference numerals have been used, the conductor is a leaky coaxial cable of normal construction where the outer conductor 3 has equal turns of wire in both left and right hand threads. A further wire 7 is inductance means. Wire 7 is wound helically onto the outer conductor 3 and in electrical contact with it in such a manner as to leave a helical gap. *d*.

In both examples the effect is such as to increase the inductance of the outer conductor as presented to the outer propagated wave for a particular calculated situation.

Cable according to the invention may be used advantageously in any system where it is required to provide radio communication between a fixed station and one or more mobile stations in a linear disposition, whether in a mine or tunnel or on the surface, such as to serve a railway or motor road, particularly where the environment is wet. Further, the line may be used for direct communication between mobile stations in known fashion by re-radiating to a second station the signals it has received from a first, or by retransmission through the fixed station.

I claim:

1. A coaxial cable leaky feeder radiating transmission line comprising an inner conductor, a dielectric surrounding the inner conductor, a perforate symmetrical outer conductor surrounding the dielectric, and including helical inductance means added to the outer conductor and wound in spaced convolutions in one helical direction for increasing inductance of the outer conductor decreasing velocity of a surface wave propagated along the outer conductor.

2. A coaxial cable according to claim 1 wherein the outer conductor is constructed of braided wire having turns of wire in opposite directions and wherein the braided wire has more turns of wire in one direction than in the other.

3. A coaxial cable according to claim 1 wherein the outer conductor comprises a braided wire and the inductance means comprises an additional conductor helically wound on the outer conductor, and wherein the additional helically wound conductor is electrically connected to the outer conductor.

4. A coaxial cable according to claim 3 wherein the additional helically wound conductor is in electrical contact with the outer conductor.

5. A coaxial cable according to claim 3 wherein the additional helically wound conductor is a heavy gauge tape.

6. A coaxial cable comprising an inner conductor, a dielectric surrounding the inner conductor, an outer conductor surrounding the dielectric, wherein the outer conductor is constructed of braided wire having turns of wire in opposite helical directions and wherein the braided wire has more turns of wire in one direction than in the other.

* * * * *